United States Patent [19]

Lambrecht

[11] Patent Number: 4,699,607

[45] Date of Patent: Oct. 13, 1987

[54] METHOD AND APPARATUS FOR PRODUCING BAGS

[75] Inventor: Emiel Lambrecht, Gijzegem-Aalst, Belgium

[73] Assignee: FMC Corporation, Chicago, Ill.

[21] Appl. No.: 795,561

[22] Filed: Nov. 6, 1985

[51] Int. Cl.[4] ..... B31D 23/98

[52] U.S. Cl. ..... 493/204; 493/196; 206/554

[58] Field of Search ..... 493/204, 196, 223, 237, 493/238; 206/554

[56] References Cited

U.S. PATENT DOCUMENTS

| | | | |
|---|---|---|---|
| 4,181,069 | 1/1980 | Porter | 493/204 |
| 4,342,564 | 8/1982 | Lehmacher | 493/195 |
| 4,406,371 | 9/1983 | Membrino | 206/554 |
| 4,451,249 | 5/1984 | DeBin | 493/204 |
| 4,468,276 | 8/1984 | Membrino | 156/510 |

*Primary Examiner*—Robert P. Olszewski
*Assistant Examiner*—William E. Terreu
*Attorney, Agent, or Firm*—Douglas W. Rudy; Richard B. Megley

[57] ABSTRACT

A method and apparatus for producing thermoplastic bags from an elongate web. Apparatus for feeding the web includes devices for producing mounting holes and perforations along a circular path surrounding the holes. The web is severed and sealed to produce sheets containing a mounting hole encircled by the perforations. A selected number of successive sheets are impaled on a post projecting through the holes. A stack having a selected number of sheets is accumulated on a post fixed to a support supporting a medial zone of the sheets which are combined by a heated punch penetrating the sheets in the area enclosed by the perforations.

3 Claims, 10 Drawing Figures

10
12
12a
14
16
18
18a
18b
18c
20
22
24
26
28
29
30
30a
32
34
36
38
40
42
44
46
48
A
B.S.
C.S.
S.S.
L.A.

METHOD AND APPARATUS FOR PRODUCING BAGS

This invention relates to methods and apparatus for producing thermoplastic bags and more particularly to the preparation of the thermoplastic web so that a maximum amount of the web defining a bag is utilized.

Patented prior art relating to the subject matter of the present invention includes U.S. Pat. No. 4,451,249, issued May 29, 1984 to De Bin and U.S. Pat. No. 4,342,564 issued Aug. 3, 1982 to Hans Lehmacher. By reference thereto it is intended that the disclosures of these patents and the references cited therein be incorporated herein.

One conventional approach followed in producing bags from folded or tubular webs of thermoplastic material is to seal and sever the web at equal intervals to produce the succession of bags which may be organized in a stack containing a desired number of bags. This approach may extend to concurrently processing more than one web strip to substantially increase the number of bags per unit time and, of course, a bag stack is generated from each web strip.

Another approach involves sealing and severing tubular webs to produce a sheet having its marginal edges closed defining a pillow. Each sheet is provided, at its medial zone, with spaced apart lines of perforations and several sheets are accumulated on a flat belt conveyor. Thereafter, the accumulated sheets are transported to a blocking and punching unit by the conveyor. At the blocking unit a heated blade is passed through the sheets centrally between the lines of perforation and substantially concurrently a pair of wicket holes is formed on each side of the blade and between the lines of perforation producing two blocked bag stacks. Bags dispensed from a stack carried by posts projecting through the wicket holes are detached along the line of perforation, which defines the mouth of the bag. Making bags according to this procedure does not utilize the web portion between the lines of perforation.

Accordingly, producing a stack of unattached bags makes use of the entire web strip while blocked stacks most generally waste a portion of the web.

According to the present invention two bags are produced from each web segment and each segment is provided with a line of perforations defining, preferably, a generally circular enclosed area located equidistance from the opposed edges of the sheet, a stack of sheets carried by a support supporting a central medial band of sheets, unified by a heated member projecting through the sheets in the perforated circular area and the sheets, if it is desired to produce individual bag stacks, are cut along the line defining the central axis of the sheets.

Further, in accordance with the present invention, a method of preparing an intermittently advanced elongated sheet of flattened tubular thermoplastic material to produce bags retained by a rupturable line of perforation is disclosed. The method includes the procedure of forming at least one aperture at regularly spaced intervals through the central medial band of the sheet, circumscribing the aperture by a line of perforation, dividing the sheet along a line transverse to direction of advance to produce segments of substantially equal dimensions with each segment containing an aperture, stacking a selected number of segments on a post carried by a support, and combining the segments by projecting a heated blade through the stack in the area circumscribed by the perforations.

Passing the heated blade through the stack will produce a combined or "blocked" stack of articles through the heat fusing or welding the contacted edges of the articles being "blocked".

DESCRIPTION OF THE PREFERRED EMBODIMENT

Figures 1, 2, 3, 4:
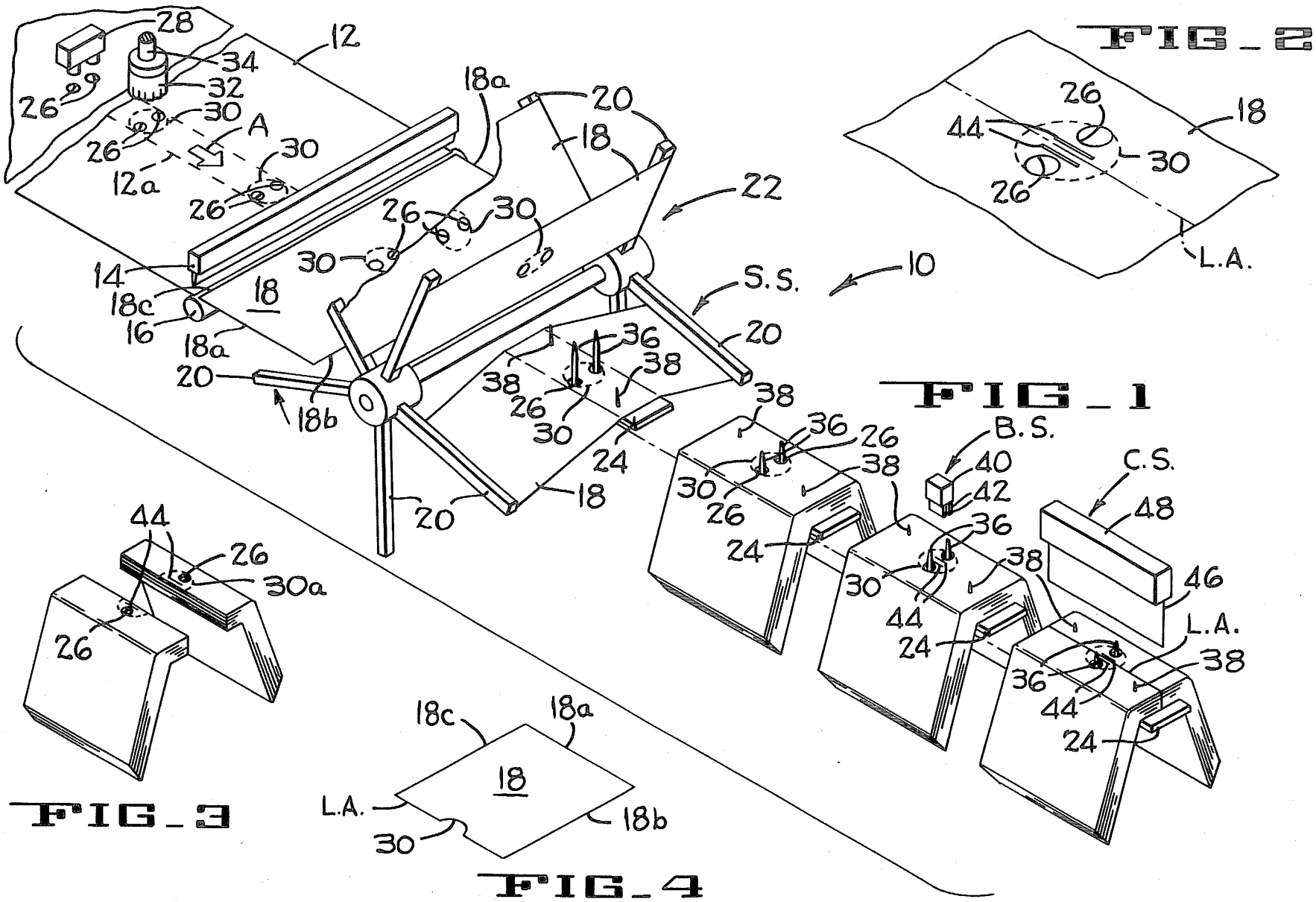
FIG. 1 is a diagrammatic perspective of a sheet preparation, transfer and stacking device associated with means for combining and separating the sheets into individual stacks.
FIG. 2 is an enlarged fragment of the sheet illustrating in greater detail a line of perforation, mounting holes and blocking lines with relation to central axis of the sheet.
FIG. 3 is a diagrammatic perspective of individual bag stacks.
FIG. 4 is a perspective of the preferred form of the bags produced by the apparatus and method of the present invention.

Exemplary apparatus to perform the methods of the present invention is shown in FIG. 1 and generally designated by the numeral 10. A web strip 12 is intermittently advanced by a conventional bag machine (not shown) which may be substantially similar to the machine disclosed in the above-referenced De Bin patent. Feed rolls or draw rolls (not shown) advance the web strip 12 a predetermined amount between a seal bar 14 and a platen roll 16 forming a sheet 18 which is engaged at its longitudinal edges 18a by a pair of transversely aligned arms 20 of a conventional transfer mechanism 22. As a sheet is formed, it is promptly engaged by a pair of the radially extending arms 20 and transferred in a generally arcuate path to one of a plurality of stacking plates 24 located at a stacking station S.S. As disclosed in the above-referenced De Bin patent, the stacking plates 24 are carried by a conveyor chain mounted on a frame defining an orbit having an upper reach and a lower reach and driven by an indexing mechanism that locates successive plates 24 at the stacking station S.S. for a selected period of time determined to accumulate a predetermined number of sheets 18 on the respective stacking plates 24.

According to the present invention, an area of the web strip 12 upstream from the seal bar 14 is provided, in its central medial zone, identified by dotted lines **12*a*, with a pair of mounting holes or apertures 26 formed by a reciprocating punching device 28 during the period of time when advance of the web strip, in the direction of the arrow A, is arrested. As the web is advanced another increment a continuous line of perforations, defining an enclosed area 30 within which the apertures 26 are located, is formed by a punch 32 having an interrupted cutting edge. The punch 32 is rigidly connected to a reciprocating rod 34 which is operated to form the lines of perforation 30** during the period of web repose.

Each web strip 18, defined by the cooperative action of the seal bar 14 and the platen roll 16, accordingly includes, in the medial zone and equidistance from the leading edge 18*b* and the trailing edge 18*c*, two mounting holes 26 located within the area of the line of perforation 30.

Each stacking plate is provided with upwardly extending posts 36 having the upper portion thereof slightly tapered and positioned to receive a succession of sheets impaled thereon as a pair of arms 20 holding a sheet approaches and sweeps by the stacking plate 24 located at the stacking station S.S. In addition to the posts 36 which project through the pre-punched holes 26, each plate 24 provided with upwardly extending sharpened pins 38 located on either side of an imaginary longitudinal axis L.A. The sharpened pins 38 puncture and penetrate the sheet as it is deposited on the stacking plate 24 and serve to firmly retain successive sheets so that a registered stack (meaning that the marginal edges of successive sheets overly each other) is produced.

On depositing a selected number of sheets on a stacking plate 24, the conveyor mounting the plates 24 is indexed, transporting the completed stack to a blocking station B.S. where the sheets are penetrated by heated blades within the area defined by the line of perforation 30. The means to effect blocking include a holder or bar 40 associated with means (not shown) such as a pneumatic or hydraulic power cylinder to forceably displace the holder 40 toward and away from the stack of sheets. The holder mounts blade-like elements 42 which are electrically heated to a temperature to effect fusion of the sheets brought in contact with the surface of the blades 42. On forceably engaging and penetrating the sheets, the blades or elements 42 produce blocking lines 44 which are shown in greater detail in FIG. 2 and it will be observed that a blocking line 44 is created on either side of the longitudinal axis L.A. and within the line of perforation 30. Accordingly, at the blocking station all the sheets are joined along the blocking lines 44.

On indexing the blocked sheets to a downstream station, preferably an adjacent downstream station, cutting of the sheets along the longitudinal axis L.A. occurs. The cutting station C.S. comprises a knife 46 mounted in a holder 48 connected to one or more conventional linear actuators operating to automatically, or at the demand of the operator, to move toward and away from the stacking plate 24 in order to divide the sheets into individual bag stacks as shown in FIG. 3. It will be observed that each bag stack includes a semicircular line of perforation 30*a*, a blocking line 44 and hole 26.

A conventional convenient way to facilitate dispensing of individual bags is to provide a fixed post, oriented horizontally or vertically, and placing the hole 26 on the post. Individual bags can be dispensed by sharply pulling the uppermost bag which will detach along the perforated line 30*a*. A datached single bag is shown in FIG. 4. As a result of this arrangement a minimal amount of web material, that circumscribed by the line of perforation 30, is waste.

The concept as described with relation to the preferred embodiment lends itself to a variety of modifications which fulfill the objective of maximizing the quantity of web material for each sheet for a bag.

Figure 5:
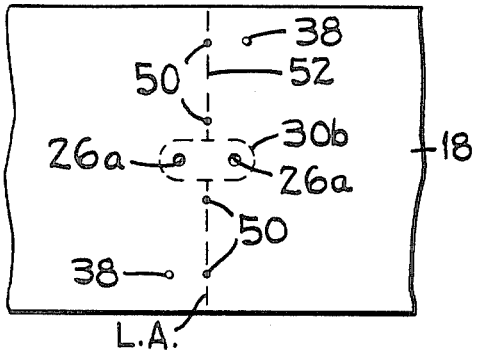
FIGS. 5 through 5E illustrates various forms of sheet preparation to produce bags that can be dispensed from a horizontal support carrying the entire sheet in saddle fashion so that bag dispensing can occur on both sides while the sheet, being supported at its center, drapes downwardly for dispensing of individual bags from individiual bag stacks as described in the preferred embodiment.

FIG. 5 discloses one configuration whereby the sheets are provided with apertures 26*a* adjacent to and on either side of the longitudinal median L.A. and the apertures 26*a* are within the area described by a line of perforation 30*b*. To unify the sheets, hot pins may penetrate the sheets along the longitudinal axis L.A. at points 50 and along that axis the line of perforation 52, interrupted by perforated area 30*b*, may be provided. A completed stack of sheets may be mounted ona saddle mount (not shown) comprising a horizontal post having upwardly extending pins projecting through the holes 26*a* and a bag may be released therefrom and separated along the line of perforation 52 and 30*b*.

Figure 5A:
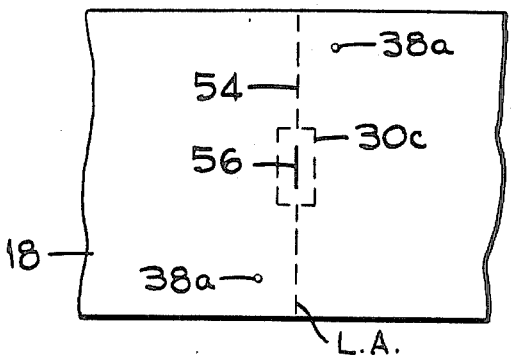

FIG. 5A shows another manner in which the sheets can be prepared. According to this construction, a line of perforation 54 coincident with the longitudinal axis L.A. extends from the edges of the sheet 18 to a central enclosed area of perforation 30*c*. Within the area defined by the perforation 30*c* a line of blocking 56, on the longitudinal axis, may be provided. The blocked area 56 may be made sufficiently large by the blocking blade to provide an opening for receiving a post to mount the sheets in saddle fashion on a dispensing appliance (not shown) of conventional construction.

Figure 5B:
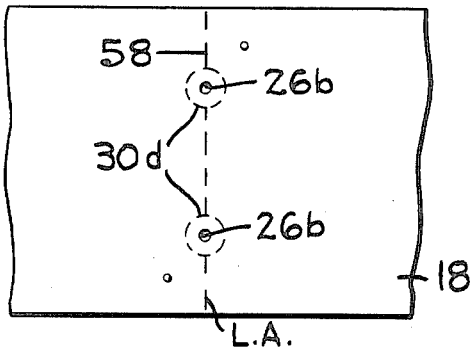

FIG. 5B illustrates another modification whereby the sheets 18 are provided with apertures 26*b* located on the longitudinal axis L.A. and each aperture is surrounded by a line of perforation 30*d* the periphery of which is intersected by a line of perforation 58. The holes or apertures 26*b* are formed by hot pins in order to unify all of the sheets of a stack. Mounting a stack of sheets on a saddle holder having posts projecting through the holes 26*b* provides a bag whose mouth or opening takes the configuration having a linear edge defined by the perforations 58 and arcuate or semicircular indentations formed by the lines of perforation 30d.

Figure 5C:
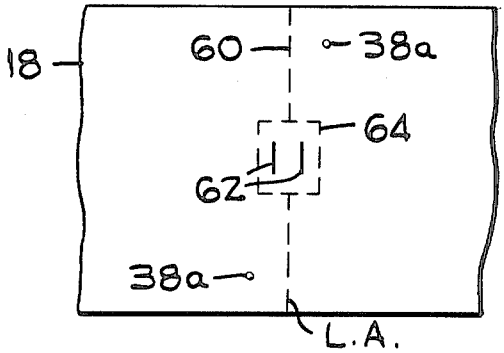
Figure 5D:
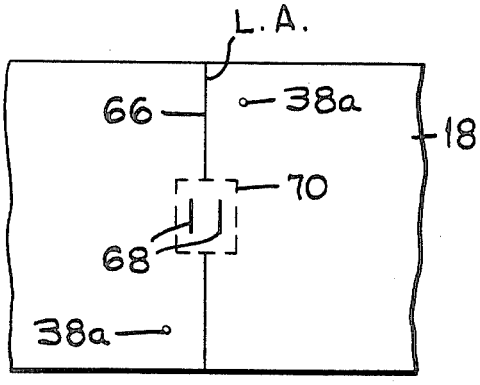

Preparing the sheets in accordance with the construction illustrated in FIG. 5c involves providing a line of perforation 60 coincident with the longitudinal axis L.A. and forming blocked apertures 62 on either side of the longitudinal axis L.A. for receiving mounting posts holding the stack of sheets in saddle fashion. The blocking apertures 62 are surrounded by a line of perforation 64 so that on removing a bag from the stack the upper edge has a medial indentation corresponding to the line of perforation 64.

The bag construction shown in 5D, as well as the construction shown in FIG. 5A and 5C, eliminates the need for apertures 26 and the pins or posts 36 of the preferred embodiment since the sheets are exclusively held in a stack by the pins 38 puncturing the sheets at 38*a*. A stack of sheets according to this construction is cut through and along the line 66 coincident with the longitudinal axis L.A. and are blocked along lines 68 on either side of the cut line 66. The blocking lines are encompased within a line of perforation 70.

Figure 5E:
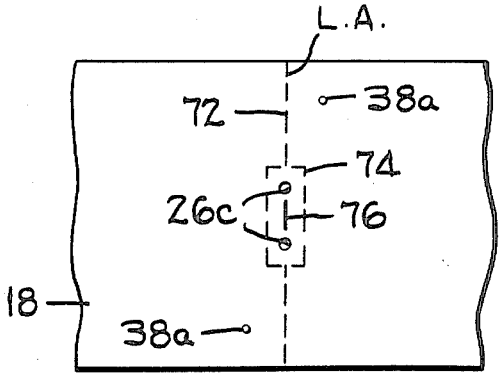

Preparing the sheets as shown in FIG. 5E comprises perforating the sheets along a line 72 which intersects and connects with an enclosed area of perforation 74 in which is formed mounting holes 26*c* on the longitudinal axis L.A. and forming therebetween a blocking line 76 formed by a heated blade. Bags are dispensed from a saddle mount having upwardly extending pins projecting through holes 26*c*.

Although the best mode contemplated for carrying out the present invention has been herein shown and described it will be apparent that modification and variations may be made without departing from what is regarded to be the subject matter of the present invention.

I claim:

1. A method of producing segments retained by a rupturable line of perforations from an intermittently advanced elongate web of flattened tubular thermoplastic material having a central medial band, said method comprising the steps of forming at least one aperture at regularly spaced intervals through the central medial band of the web, circumscribing the aperture by a line of perforations, dividing the web along a line transverse to its direction of advance into segments that are of substantially equal dimensions with each segment containing an aperture, stacking a plurality of said segments on a post carried by a support, and combining the segments by projecting a heated blade through the stack within the area circumscribed by the perforations.

2. A method of producing bags from an intermittently advanced elongated web of thermoplastic material having a central medial portion that is divided, during periods of repose, into segments of substantially equal dimensions, said method comprising the steps of forming at least one aperture in the central medial portion of the web, perforating the medial portion along a line defining a closed path circumscribing the aperture, transversely severing and sealing the web to produce a segment containing the circumscribed aperture, transferring and supporting the medial portion of the segment on a support provided with a post which penetrates the aperture, accumulating a number of said segments on the support to define a stack, combining the segments in the stack by passing a heated member through the segments within the area defined by the line of perforations, and dividing the stack of segments along a line defining the longitudinal median of the web to define two bag stacks.

3. A method of producing segments retained by a rupturable line of perforations from an intermittently advanced elongate web of flattened tubular thermoplastic material having a central medial band, said method comprising the steps of:

forming at least one aperture at regularly spaced intervals through the central medial band of the web;

circumscribing the aperture by a line of perforations;

dividing the web along a line transverse to its direction of advance into segments that are of substantially equal dimensions with each segment containing an aperture;

stacking a plurality of said segments on a post carried by a support; and combining the segments by penetrating the stack with at least one heated member projected within the area surrounded by the perforations.

* * * * *